United States Patent [19]

Baur et al.

[11] 4,293,424

[45] Oct. 6, 1981

[54] PROCESS FOR CLEANING ROLLING LUBRICANT

[75] Inventors: Rudolf Baur; Emil Merki; Hanspeter Krähenbühl, all of Kreuzlingen, Switzerland

[73] Assignee: Swiss Aluminium Ltd., Chippis, Switzerland

[21] Appl. No.: 834,130

[22] Filed: Sep. 19, 1977

Related U.S. Application Data

[63] Continuation of Ser. No. 672,061, Mar. 31, 1976, abandoned.

[30] Foreign Application Priority Data

Apr. 10, 1975 [CH] Switzerland ..... 4554/75

[51] Int. Cl.[3] ..... B01D 21/01

[52] U.S. Cl. ..... 210/737; 208/179; 210/702

[58] Field of Search ..... 208/179–183; 210/28, 42 R, 45, 51–53, 56, 59, 60, 168, 177, 181, 182, 665, 702, 708, 712, 717, 723–728, 737, 749, 765, 766

[56] References Cited

U.S. PATENT DOCUMENTS

| | | | |
|---|---|---|---|
| 110,364 | 12/1870 | Houlker | 208/179 |
| 1,619,869 | 3/1927 | Jackson | 208/179 |
| 1,698,257 | 1/1929 | Cherry | 208/179 |
| 2,305,464 | 12/1942 | Ashworth | 210/177 |
| 2,703,783 | 3/1955 | Popkin | 210/56 |
| 2,902,439 | 9/1959 | Milz et al. | 208/183 |
| 2,952,624 | 9/1960 | Lister et al. | 208/179 |

FOREIGN PATENT DOCUMENTS

| | | | |
|---|---|---|---|
| 5236872 | 9/1973 | Japan | 210/56 |
| 1041703 | 9/1966 | United Kingdom | 208/183 |

*Primary Examiner*—Peter A. Hruskoci
*Attorney, Agent, or Firm*—Bachman and LaPointe

[57] ABSTRACT

Lubrication oils used in rolling strip and foil in the light metal industing are contaminated with fine metallic particles during rolling. The process described here allows these oils to be cleaned either continuously or in a batch process by adding a strongly alkaline solution to the warm contaminated oil whereby these fine particles coagulate and can be separated out by means of centrifuging or filtering.

10 Claims, 1 Drawing Figure

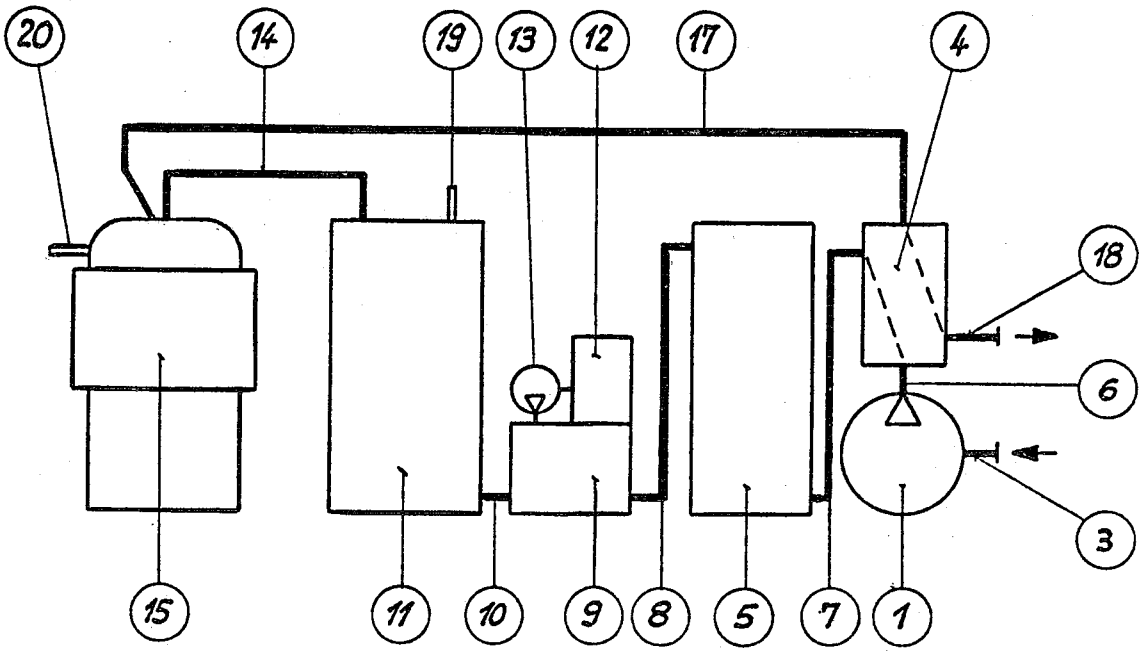
20
14
19
13
12
17
4
18
6
3
15
11
10
9
8
5
7
1

PROCESS FOR CLEANING ROLLING LUBRICANT

This is a continuation of application Ser. No. 672,061, filed on Mar. 31, 1976 now abandoned by Rudolf Baur et al.

PROCESS FOR CLEANING ROLLING LUBRICANT

The invention concerns a process for cleaning rolling lubricant without the aid of filtering agents, and concerns in particular the high quality rolling oils which are used in the light metal industry. The contaminated rolling lubricants are freed, either continuously or in a batch process, of metallic fines using strongly alkaline solution in a coagulator with subsequent separation of the coagulate in a centrifuge or filter.

Several processes for removing metallic particles from rolling lubricants are already known. The smallness of the particle dimensions however requires a level of investment and labour which are disproportionately large and such processes are therefore uneconomical.

According to a known stationary, batch process the dirty lubricant is cleaned with dilute sulphuric acid. The cleaning process lasts approximately one hour, during which the metallic fines e.g. of aluminium, are dissolved. Rolling mill users do not however like to use sulphuric acid, as this reacts with the lubricant oil to form sulphonic acids. These undesireable organic acids can be removed from the cleaned lubricant only with the greatest difficulty.

Another known process is such that the contaminated lubricant is filtered through activated bauxite or kieselguhr. This process is very expensive not only because of the small throughput, but also because of the high expenditure on materials. Thus, for example, to remove approximately 1 ton of metal fines about 40 tons of filter sand soaked in 40 tons of petrol are used. The present day laws concerning the protection of the environment no longer permit such used filter sand containing large amounts of oil simply to be dumped. Instead the sand must be made oil-free by means of a difficult process e.g. by roasting, at considerable cost of course.

Finally there is also a process for removing metal fines from contaminated lubrication oil by centrifuging. With this process however only particles above a certain diameter are removed whilst finer particles remain in the lubricant.

The object of the invention is therefore to provide a process for cleaning rolling lubricants which contain fines from material rolled into a strip-shaped semi-finished product, and containing metals which react with alkaline solutions, in particular light metals, in which process the metallic fines of a particle size down to the order of 0.1 $\mu$m are brought into such a form that easy and economical separation from the rolling lubricant is assured.

The object is achieved by way of the invention in that a strongly alkaline, aqueous solution of an inorganic salt is added to the heated dirty oil.

In accordance with a preferred version of the invention the strongly alkaline solution which has a pH value of at least 9 is produced by dissolving an appropriate amount of alkali metal carbonate in water.

The strongly alkaline solutions are not poisonous and even in the case of gross mistakes in handling no material damage will result.

Surprisingly, the addition of the strongly alkaline solution to the lubricating oil contaminated with metallic particles, effects a rapid, complete coagulation without the two liquid phases having to be mixed intimately.

It is clear that the strongly alkaline solution effects a chemical change in the surface of the metallic fines by de-charging the polarized boundary layer by a moderate production of hydrogen, and that this effect extends like an avalanche, whereby the finely divided, non-charged metallic particles ball up as a coagulate. Up to now it has not been possible to find a theoretical explanation for this surprising coagulation-effect.

The excess alkaline solution which is not used up by the chemical reaction at the surface is completely absorbed by the fine particles.

The continuously formed coagulate is removed in a centrifuge, filtering device or preferably however in a chamber centrifuge, the batch formed coagulate is allowed to sediment in a container. The precipitated coagulate precipitates out as an essentially dry, spoonable layer, which can be taken out of the device easily and clean.

The precipitate has a very low oil content of 5–10%, which permits trouble-free disposal of this material on open rubbish dumps or at an incinerator plant.

Thanks to the compact construction of the device for carrying out the dynamic process a large throughput of dirty oil can be achieved at relatively low cost. These large throughputs can be achieved in a small fraction of the space required by devices for carrying out conventional filtering or centrifuging processes.

The material flow necessary for cleaning the rolling lubricant can be reduced by means of the invention by up to a factor of 100 and at the same time with a higher level of cleaning and understandably with enormously improved economics.

The device for carrying out the dynamic process will now be described in some detail with the aid of the schematic drawing.

The dirty oil is sucked via a pipe 3 out of the container (not shown) by a pump 1 and then pumped into a continuous-feed heater 5 via a heat exchanger 4 which cools processed lubricant. The pump and the heat exchanger are connected by a pipe 6, the heat exchanger and the continuous-feed heater are connected with a tube 7 for the dirty oil. In the continuous-feed heater the contaminated lubricant is heated to 60°–95° C. and preferably to 80°–95° C. Next the warm, dirty lubricant is led, by the pump 1 which provides circulation through the whole circuit, through a connecting pipe 8 into the mixing stage 9 of a coagulator 11 (capacity approx 100 l) which is connected by the pipe 10. At the mixing stage the strongly alkaline aqueous solution is pumped from the tank 12 in controlled amounts by the pump 13 through a nozzle (not shown here) into the mixing stage. The amount of alkaline solution added corresponds with the level of contamination (oxide ash content) and with the rate of throughput of the dirty oil (approx 400–1200 liters per hour), and is approx 0.5–1.5 liters of strongly alkaline solution per hour. After flowing for a short interval through the coagulator 11, which is in fact the reaction vessel, the lubricant is pumped with the coagulated metal fines via a pipe 14 into a chamber centrifuge 15. The coagulate is separated out from the liquid in this centrifuge.

The filtrate, pure rolling lubricant without any trace of the constituents of the alkaline solution is pumped through the return pipe 17 back to the starting position.

In doing so the warm oil flows through, and is cooled somewhat in, the heat exchanger where it pre-heats the dirty oil entering the circuit, before being led out of the circuit by the pipe 18.

For safety purposes valves 19 and 20 are provided on the coagulator and the chamber centrifuge 15 respectively for hydrogen and excess pressure.

EXAMPLES

The examples 1–3 refer to the continuous cleaning of rolling lubricant using a coagulator and a commercially available chamber centrifuge (Westfalia HG 10006, 4700 rpm). Example no. 4 concerns the static or batch cleaning of rolling lubricant by means of coagulation. In all examples a soda solution of 230 g $Na_2CO_3$ per liter of solution is added, in doses if required.

EXAMPLE 1

Highly contaminated oil from the rolling of aluminium foil, can having an oxide ash content of 0.36% (weight percent) was cleaned by by-pass cleaning using a coagulator. The throughput of oil which was heated to 85° C. was 400 l/h; 1.5 l/h of soda solution was added in this case. The cleaned oil had an oxide ash content of 0.002%.

EXAMPLE 2

Used oil from the initial passes in foil rolling and having an oxide ash content of 0.12% was cleaned as described in example no 1. The rate of throughput of the oil which was heated in the process to 85° C. was 600 l/h; 0.8 l of soda solution was added per hour. The cleaned oil had an oxide ash content of 0.001%.

EXAMPLE 3

Used oil from the double pass stage in foil rolling and having an oxide ash content of 0.08% was cleaned as in example 1. The throughput of the oil which was heated to 85° C. in the process was 800 l/h; 0.5 l of soda solution was added per hour. The cleaned rolling lubricant had an oxide ash content of 0.0007%.

EXAMPLE 4

1000 l of highly contaminated lubricating oil from the foil rolling mill and having an ash content of 0.3% was treated in a container with 25 l of soda solution. The rolling oil temperature was 95° C., the sedimentation time 24 h. The cleaned oil had an ash content of 0.001%.

What we claim is:

1. A process for cleaning a rolling lubricant oil contaminated with fine particles of aluminum which consists essentially in:

heating a stream of said oil;

mixing into said stream a stream of aqueous alkali metal carbonate solution having a pH above 9 and having a concentration of about 150 to about 250 grams of $Na_2CO_3$ per liter, wherein the ratio of said contaminated oil to said solution is about 400 to 1200 liters of said oil to about 0.5 to about 1.5 liters of said solution, thereby coagulating said particles in said stream; and removing said coagulated particles from said oil to provide cleaned rolling lubricant.

2. A process according to claim 1 wherein the coagulated particles are removed by filtration.

3. A process according to claim 1 wherein the coagulated particles are removed by centrifuging.

4. A process according to claim 1 wherein said heated oil has a temperature in the range from about 60° to about 95° C.

5. A process according to claim 4 wherein said temperature range is from 80° to 95° C.

6. A process according to claim 1 wherein the coagulated particles are allowed to sediment in a container.

7. A process according to claim 1 wherein the cleaned rolling lubricant is used at least in part to preheat the contaminated rolling lubricant.

8. A process according to claim 1 wherein the contaminated rolling lubricant is fed to a heater for heating, to a mixer for admixing with said alkali metal carbonate, to a coagulator for coagulating said particles, and to a centrifuge for removing the coagulated particles.

9. A process for continuously cleaning a rolling lubricant oil contaminated with fine particles of aluminum which consists essentially in:

continuously heating a stream of said oil;

continuously mixing into said stream a stream of aqueous alkali metal carbonate solution having a pH above 9 and having a concentration of about 150 to about 250 grams of $Na_2CO_3$ per liter, wherein the ratio of said contaminated oil to said solution is about 400 to 1200 liters of said oil to about 0.5 to about 1.5 liters of said solution, thereby coagulating said particles in said stream; and continuously removing said coagulating particles from said oil to provide cleaned rolling lubricant.

10. A process according to claim 9 wherein said heated oil has a temperature in the range from about 60° to about 95° C.

* * * * *